US012564293B1

(12) United States Patent
Chen

(10) Patent No.: US 12,564,293 B1
(45) Date of Patent: Mar. 3, 2026

(54) MULTIFUNCTIONAL INFANT BATHING SYSTEM

(71) Applicant: Taizhou Huangyan Yujin E-commerce Co., Ltd., Taizhou (CN)

(72) Inventor: Hui Chen, Taizhou (CN)

(73) Assignee: Taizhou Huangyan Yujin E-commerce Co., Ltd., Taizhou (CN)

( * ) Notice: Subject to any disclaimer, the term of this patent is extended or adjusted under 35 U.S.C. 154(b) by 0 days.

(21) Appl. No.: 19/231,390

(22) Filed: Jun. 6, 2025

(30) Foreign Application Priority Data

May 29, 2025 (CN) ..... 202521091440.2

(51) Int. Cl.
*A47K 3/064* (2006.01)

(52) U.S. Cl.
CPC ..... *A47K 3/064* (2013.01)

(58) Field of Classification Search
CPC ..... A47K 3/064; A47K 3/062; A47K 3/06
USPC ..... 4/538
See application file for complete search history.

(56) References Cited

U.S. PATENT DOCUMENTS

| | | | | |
|---|---|---|---|---|
| 5,361,430 | A * | 11/1994 | Wise | A47K 3/024 4/573.1 |
| D422,345 | S * | 4/2000 | Dixon | D23/278 |
| 10,433,679 | B2 * | 10/2019 | Kwak | F16B 2/22 |
| 12,144,474 | B2 * | 11/2024 | Saxton | A47K 3/024 |
| 12,178,367 | B1 * | 12/2024 | Chen | A47K 3/064 |
| 2022/0079390 | A1 * | 3/2022 | Pruzhansky | A47K 3/024 |

* cited by examiner

*Primary Examiner* — Huyen D Le

(57) ABSTRACT

A multifunctional infant bathing system includes a bathtub body and a bath cushion. The bathtub body includes a bottom wall and a side wall. The bottom wall and the side wall form an accommodating cavity for holding liquid. An edge of the bathtub body extends upwards to form the side wall. The bath cushion includes a support portion, a first mounting portion, and a second mounting portion. The first mounting portion and the second mounting portion are respectively detachably connected to an edge of the side wall. The support portion is used for supporting an infant. The first mounting portion and the second mounting portion respectively fix two ends of the support portion, so that the support portion and the bottom wall are arranged opposite to each other, allowing the support portion to support the infant while being suspended above the bottom wall.

19 Claims, 6 Drawing Sheets

MULTIFUNCTIONAL INFANT BATHING SYSTEM

CROSS-REFERENCE TO RELATED APPLICATIONS

The application claims priority of Chinese patent application CN2025210914402, filed on May 29, 2025, which is incorporated herein by reference in its entireties.

TECHNICAL FIELD

The present invention relates to the technical field of infant bathing, particularly to a multifunctional infant bathing system.

BACKGROUND ART

Bathing is an important and frequent daily activity in the care of infants. Due to the incomplete physical development and lack of self-control ability of infants, their bathing process relies on adult assistance. However, when adults help infants bathe, to prevent infants from choking on water, adults often need to support infants' heads with one hand and wash the infants with the other hand. This not only increases the difficulty of operation of the adults, but also limits the flexibility and efficiency of the bathing process. In traditional infant bathing methods, there is a lack of auxiliary devices specifically designed for the bathing of infants, which leads to many inconveniences and safety hazards during the bathing process, making it easy for infants to get injured or feel uncomfortable during the bathing process.

SUMMARY

The main objective of the present invention is to provide a multifunctional infant bathing system, aiming to solve the problems of high operational difficulty for adults, low flexibility during the bathing process, and potential safety hazards when an infant is bathed.

To achieve the above objective, the present invention provides a multifunctional infant bathing system. The multifunctional infant bathing system includes:

- a bathtub body, wherein the bathtub body includes a bottom wall and a side wall, the bottom wall and the side wall form an accommodating cavity for holding liquid, and an edge of the bathtub body extends upwards to form the side wall; and
- a bath cushion, wherein the bath cushion includes a support portion, a first mounting portion, and a second mounting portion; the first mounting portion and the second mounting portion are respectively detachably connected to an edge of the side wall, and the support portion is used for supporting an infant.

In one embodiment, the support portion includes:

- a back cushion, wherein the back cushion is arranged opposite to the bottom wall, the first mounting portion is arranged on a first end of the back cushion, and the first mounting portion is detachably connected to a top edge of the side wall positioned on a first end of the bathtub body; and
- a support cushion, wherein a first end of the support cushion is flexibly connected to a second end of the back cushion, the second mounting portion is arranged on a second end of the support cushion, and the second mounting portion is detachably connected to any position of an edge of the side wall positioned on a second end of the bathtub body, so as to adjust a relative position of the support cushion and the back cushion, thereby providing better support for the infant.

In one embodiment, the support cushion includes:

- a first support cushion, wherein a first end of the first support cushion is flexibly connected the second end of the back cushion, two leg holes are defined in the first support cushion, the two leg holes are arranged at intervals, and the second mounting portion is positioned at an end portion of a second end of the first support cushion; and
- a second support cushion, wherein a first end of the second support cushion is connected to the second end of the back cushion, the second support cushion is spaced apart from the bottom wall and positioned below the first support cushion, a second end of the second support cushion is also provided with a connecting member, and the first support cushion is detachably connected to the second support cushion through the connecting member.

In one embodiment, the multifunctional infant bathing system further includes a third mounting portion.

An end portion of the second end of the first support cushion is further provided with a through hole extending along a width direction. The third mounting portion is detachably arranged in the through hole. Two ends of the third mounting portion are detachably connected to the side wall in the middle of the bathtub body.

In one embodiment, a tail end of the side wall extending upwards is provided with a curved portion.

In one embodiment, the first mounting portion includes a top connecting strap and a top fixing buckle. A first end of the top connecting strap is connected to a lower surface of the back cushion, and the top fixing buckle is arranged at a second end of the top connecting strap. The top fixing buckle is coupled to the curved portion at a top portion of the side wall.

In one embodiment, the second mounting portion includes a lateral fixing buckle. Two sides of a second end of the support cushion each extend to form a lateral connecting strap. The lateral fixing buckle is arranged at one end of the lateral connecting strap facing a support portion. The lateral fixing buckle is coupled to the curved portion of an edge of the side wall on a second end of the bathtub body.

In one embodiment, the third mounting portion includes a support rod and insertion members. The insertion members are two in number. Two ends of the support rod are respectively connected to the two insertion members. The two insertion members are respectively inserted into the side wall in the middle of the bathtub body.

In one embodiment, the insertion member includes a fixing seat and a movable buckle. A first side of the fixing seat facing the bath cushion is provided with a receiving slot for receiving an end portion of the support rod. A second side of the fixing seat is provided with the movable buckle for coupling the fixing seat to the side wall.

In one embodiment, the insertion member further includes a restoration spring. The fixing seat is hinged to the movable buckle. The movable buckle is provided with a groove for receiving the restoration spring. A first end of the restoration spring abuts against the fixing seat, and a second end of the restoration spring abuts against the movable buckle.

In one embodiment, a limiting slot is defined in the movable buckle. A limiting portion is arranged on the side wall in the middle of the bathtub body. The limiting portion is snapped into the limiting slot.

In one embodiment, the infant bathing system further includes a cover plate. The cover plate is disposed at a top edge of the side wall on a first end of the bathtub body.

In one embodiment, the infant bathing system further includes a bracket for supporting the bathtub body. The bracket is arranged at a bottom portion of the bathtub body.

In one embodiment, the infant bathing system further includes a hinge member. The hinge member is fixed to a bottom portion of the bathtub body. The hinge member is used for connecting a bracket and the bathtub body, so that after the bracket rotates relative to the bathtub body, the bracket enters a usage state or a storage and folding state.

In one embodiment, the second end of the first support cushion is provided with a plurality of openings. A total number of the connecting members is multiple. The connecting members are configured as snap buttons. The snap buttons are snapped into the openings of the first support cushion.

In one embodiment, the bath cushion is made of a flexible material.

In one embodiment, the curved portion is inverted U-shaped.

In one embodiment, the infant bathing system further includes a blocking member. A water outlet hole is defined in the bottom wall. The blocking member is detachably installed inside the water outlet hole.

In one embodiment, a lower surface of the bottom wall is provided with a first anti-slip pattern.

In one embodiment, a surface of the bath cushion used for supporting the infant is provided with a second anti-slip pattern.

The technical solution of the present invention adopts the multifunctional infant bathing system. The multifunctional infant bathing system includes the bathtub body and the bath cushion. The bathtub body includes the bottom wall and the side wall. The bottom wall and the side wall form the accommodating cavity for holding liquid. The edge of the bathtub body extends upwards to form the side wall. The bath cushion includes the support portion, the first mounting portion, and the second mounting portion. The first mounting portion and the second mounting portion are respectively detachably connected to the edge of the side wall. The support portion is used for supporting the infant. In this way, the first mounting portion and the second mounting portion are respectively detachably connected to the edge of the side wall, so that when the first mounting portion and the second mounting portion are fixed to the edge of the side wall, two ends of the support portion are respectively fixed, allowing the support portion and the bottom wall to be arranged opposite to each other. Therefore, the support portion can support the infant and be suspended above the bottom wall, thereby making it easier and more convenient for adults to operate when bathing the infant.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
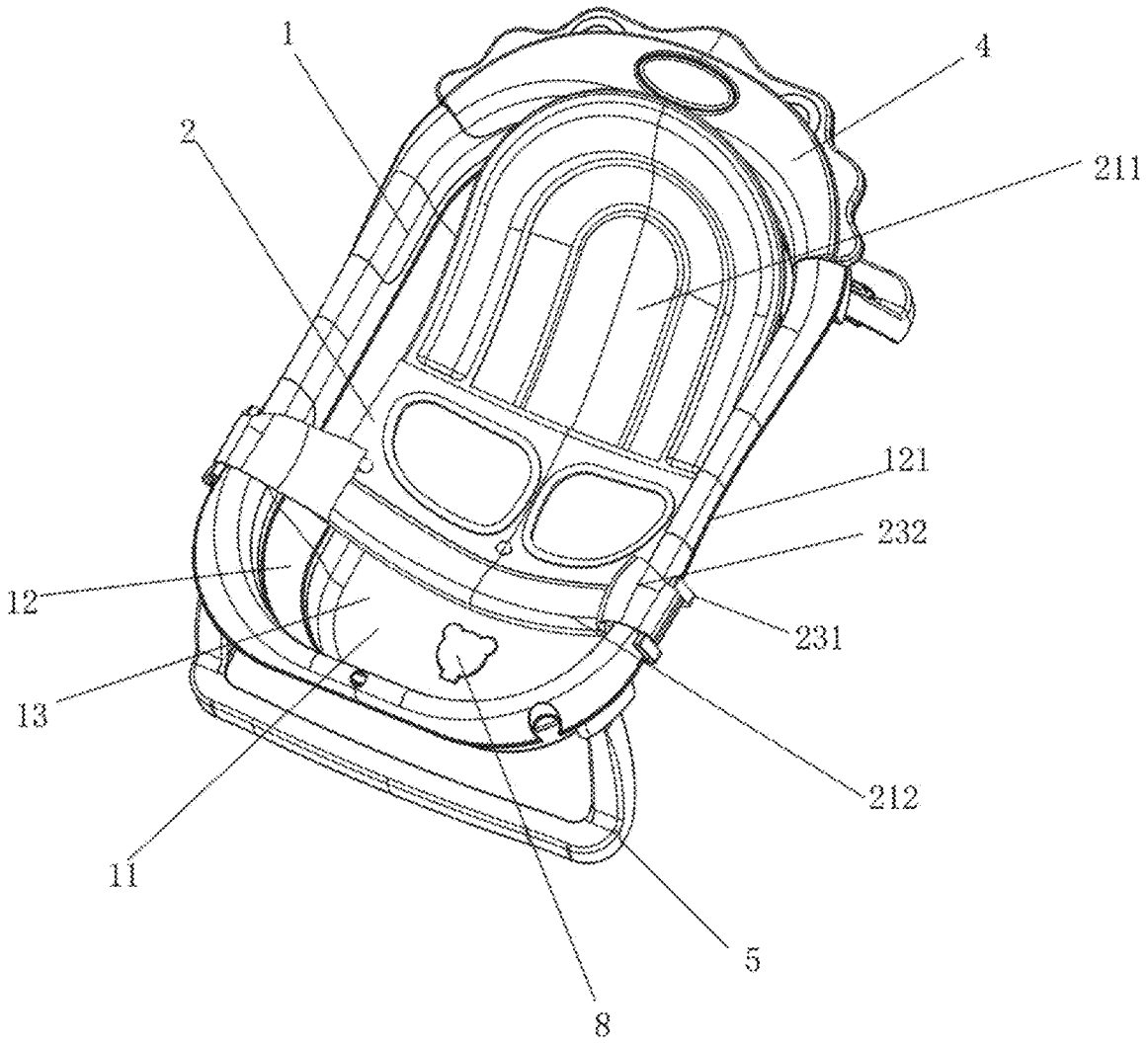
FIG. 1 is a schematic structural diagram of one embodiment of a multifunctional infant bathing system according to the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
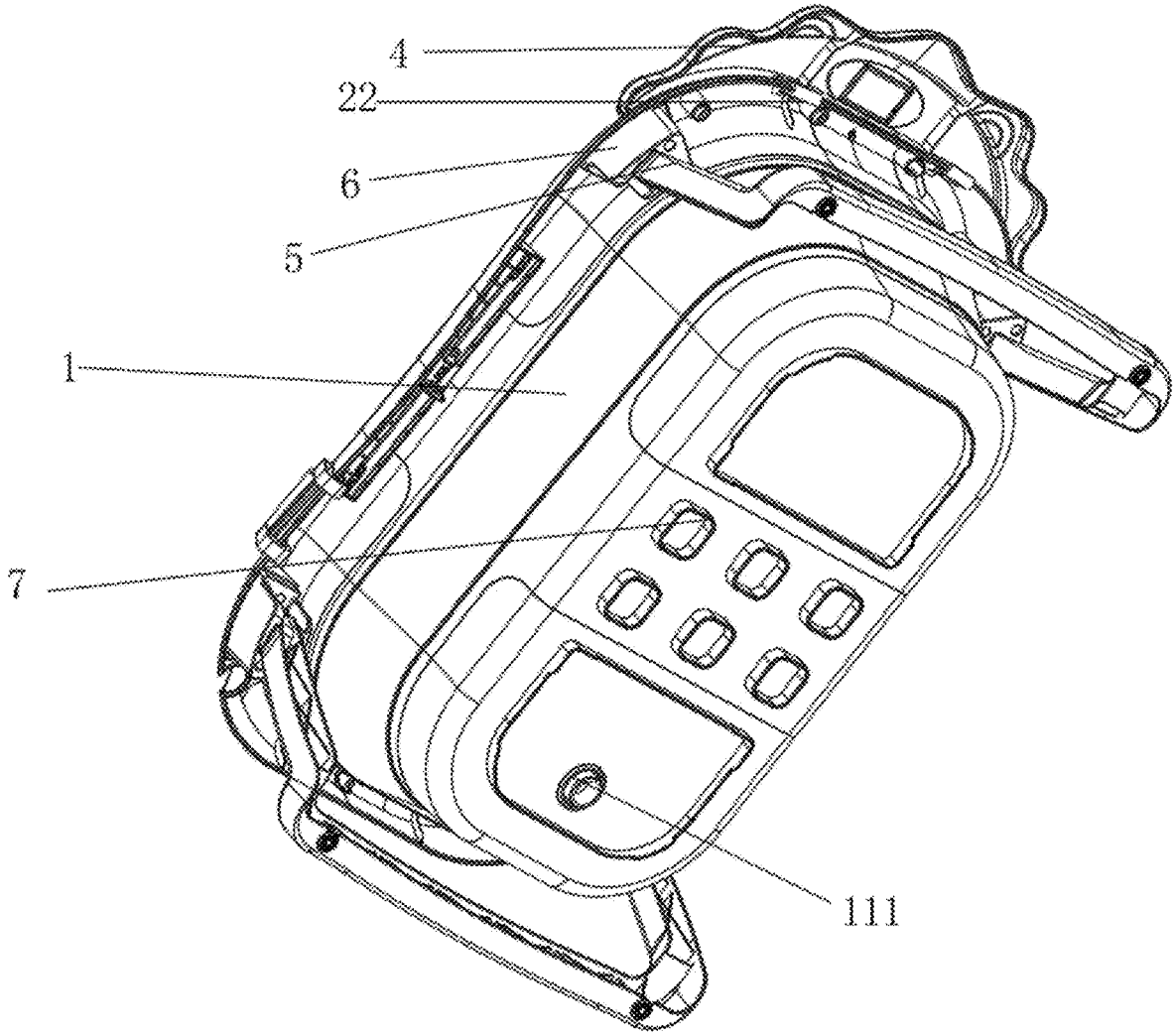
FIG. 2 is a schematic structural diagram of the multifunctional infant bathing system in FIG. 1 from an angle of view.
Figure 3:
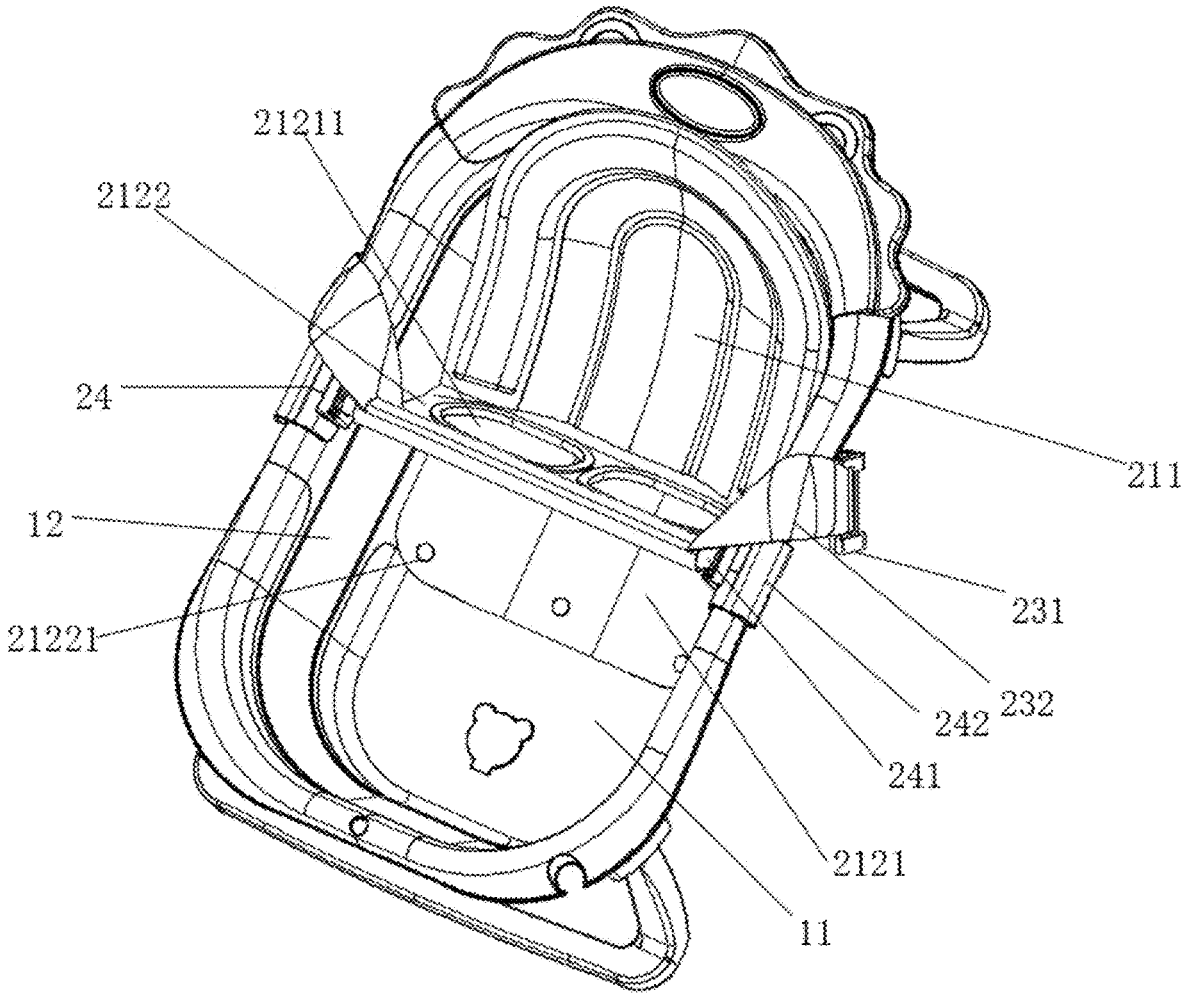
FIG. 3 is a schematic structural diagram of another embodiment of a multifunctional infant bathing system according to the present invention.
Figure 4:
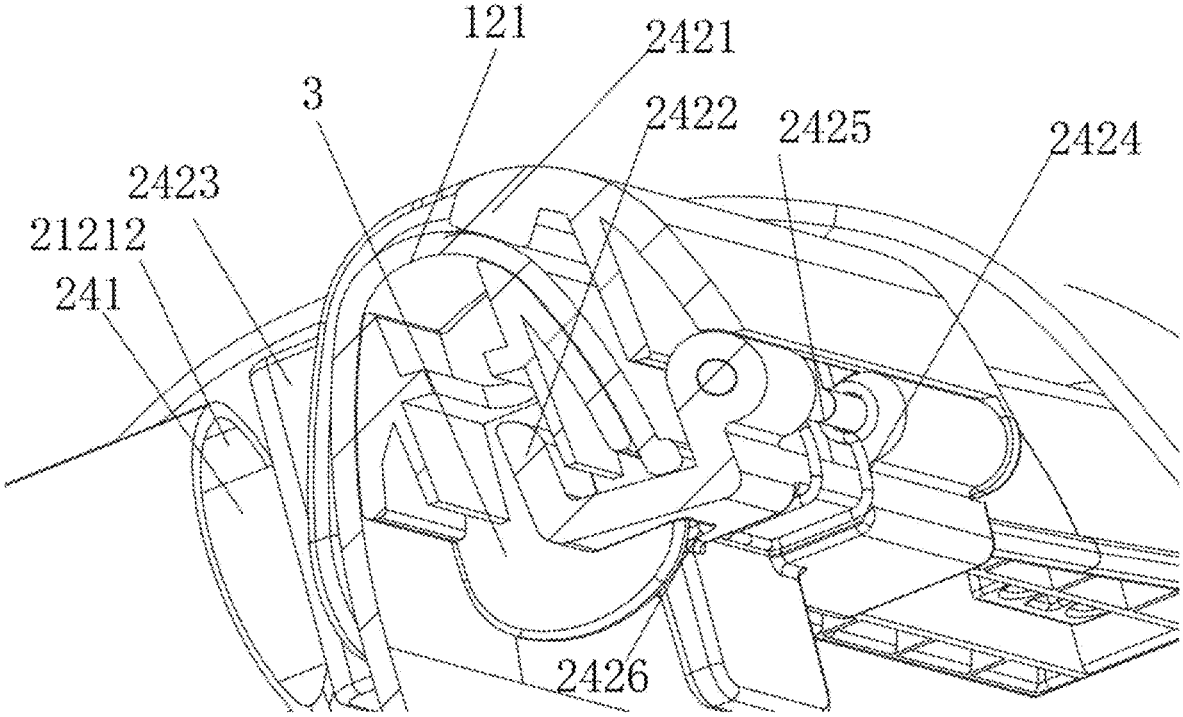
FIG. 4 is a cross-sectional view showing the connection between a third mounting portion and a curved portion in another embodiment of a multifunctional infant bathing system according to the present invention.
Figure 5:
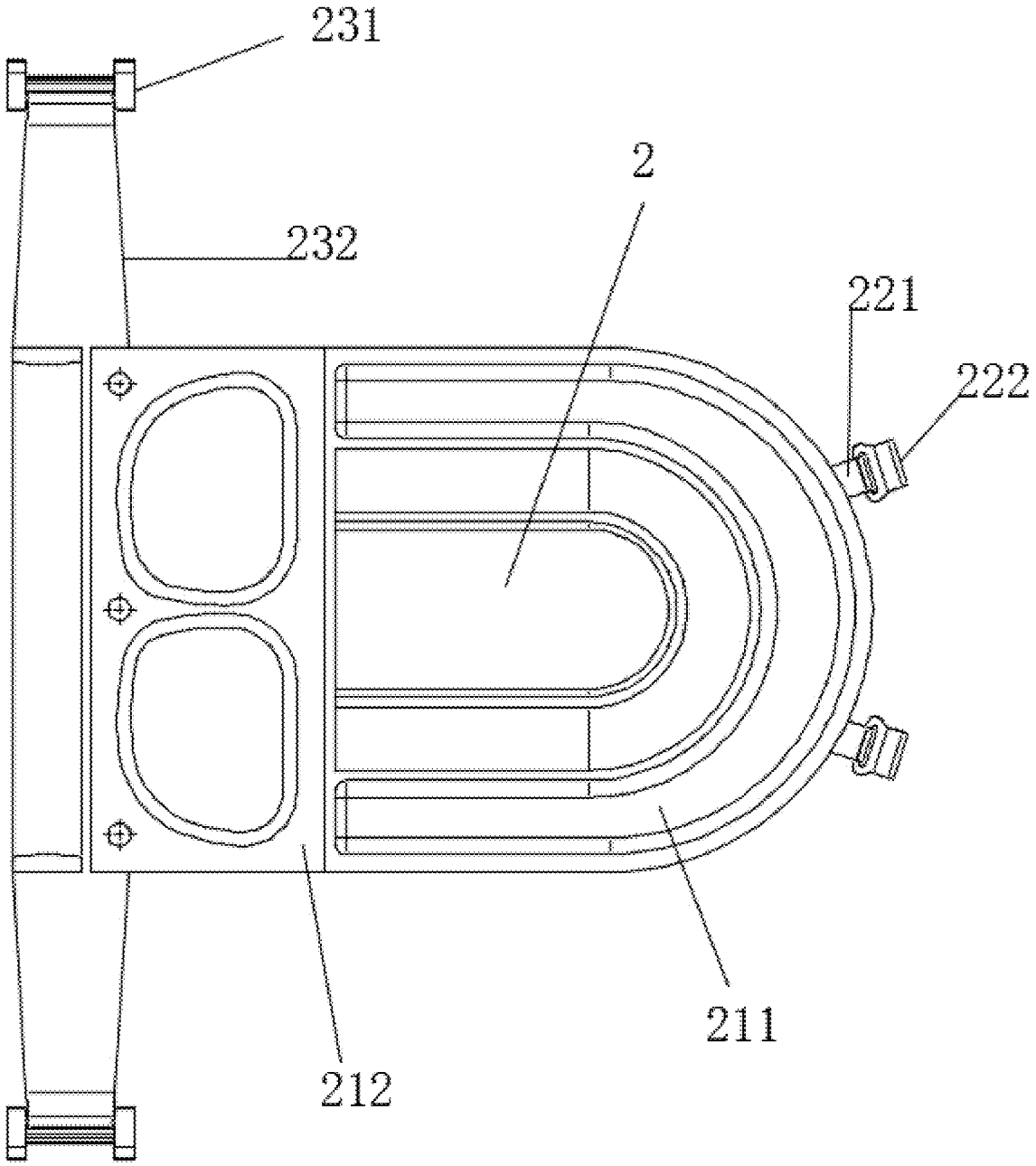
FIG. 5 is a schematic structural diagram of a bath cushion in one embodiment of a multifunctional infant bathing system according to the present invention.
Figure 6:
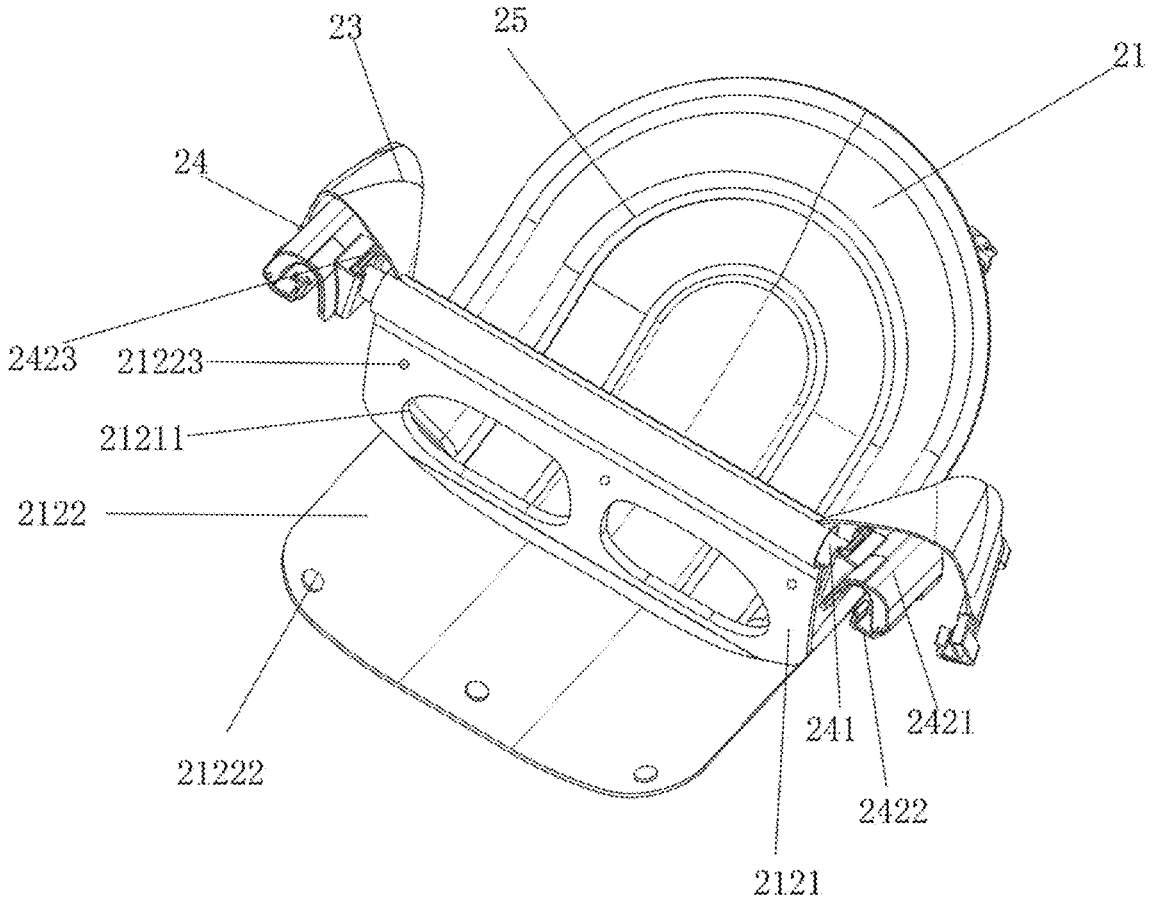
FIG. 6 is a schematic structural diagram of a bath cushion in yet another embodiment of a multifunctional infant bathing system according to the present invention.

Referring to FIGS. 1-6, the present invention provides a multifunctional infant bathing system. The multifunctional infant bathing system includes:

- a bathtub body 1, wherein bathtub body 1 includes a bottom wall 11 and a side wall 12, the bottom wall 11 and the side wall 12 form an accommodating cavity 13 for holding liquid, and an edge of the bathtub body 1 extends upwards to form the side wall 12; and
- a bath cushion 2, wherein the bath cushion 2 includes a support portion 21, a first mounting portion 22, and a second mounting portion 23; the first mounting portion 22 and the second mounting portion 23 are respectively detachably connected to an edge of the side wall 12, and the support portion 21 is used for supporting an infant.

In this embodiment, the bathtub body 1 includes the bottom wall 11 and the side wall 12. The bottom wall 11 can be configured in a circular, elliptical, square, rectangular, or other shape suitable for infant bathing, so as to adapt to usage needs of different families. A material of the bottom wall 11 can be selected from durable and easy-to-clean materials such as plastic or stainless steel, ensuring the stability and service life of the bathtub body 1. An edge of the bottom wall 11 is provided with the side wall 12 extending upward. A height of the side wall 12 can be adjusted according to actual needs to ensure safety and comfort during the bathing process. The support portion 21 of the bath cushion 2 is designed with soft and breathable materials, such as sponge or memory foam, to provide a comfortable bathing experience for the infant. The first mounting portion 22 and the second mounting portion 23 can be designed as snap-fit structures that match the edge of the side wall 12, such as hook-and-loop fasteners, snap fasteners, or hooks, so that the bath cushion 2 can be firmly fixed on the bathtub body 1, thereby preventing the bath cushion 2 from sliding or detaching during bathing due to the infant's weight pressing on the support portion 21.

In one embodiment, the support portion 21 includes a back cushion 211 and a support cushion 212.

The back cushion 211 is arranged opposite to the bottom wall 11. The first mounting portion 22 is arranged on a first end of the back cushion 211. The first mounting portion 22 is detachably connected to a top edge of the side wall 12 positioned on a first end of the bathtub body 1.

A first end of the support cushion 212 is flexibly connected to a second end of the back cushion 211. The second mounting portion 23 is arranged on a second end of the support cushion 212. The second mounting portion 23 is detachably connected to any position of an edge of the side wall 12 positioned on a second end of the bathtub body 1, so as to adjust a relative position of the support cushion 212 and the back cushion 211, thereby providing better support for the infant.

In this embodiment, the back cushion 211 is detachably connected to the top edge of the side wall 12 on the first end of the bathtub body 1 through the first mounting portion 22, and the second mounting portion 23 is detachably connected to any position of the edge of the side wall 12 positioned on the second end of the bathtub body 1. Therefore, when the first mounting portion 22 and the second mounting portion 23 are fixed on the edge of the side wall 12, the back cushion 211 is suspended on the bottom wall 11. The first end of the support cushion 212 is flexibly connected to the second end of the back cushion 211, and the second end of the support cushion 212 can be connected to a position of the second end of the bathtub body 1 by adjusting the second mounting portion 23, so that the support cushion 212 can bend or fold relative to the back cushion 211, allowing the support portion 21 to adapt to the body shapes and sitting posture needs of different infants. In addition, the flexible connection design between the support cushion 212 and the back cushion 211 makes the structure of the entire support portion 21 more flexible to be adjusted according to the actual situation of the infant, ensuring the comfort of the infant inside the bathtub body 1.

Specifically, both the first mounting portion 22 and the second mounting portion 23 adopt designs that are easy to disassemble and install, such as buckles, hook-and-loop fasteners, or threaded connections, to facilitate a user to quickly disassemble and adjust the support portion 21 as needed. The first end of the bathtub body 1 can be specifically configured as a front end of the bathtub body 1, and the second end of the bathtub body 1 can be configured as an area from a middle end to a rear end of the bathtub body 1. Therefore, by adjusting the specific position of the second mounting portion 23 connecting to the second end of the bathtub body 1, the user can further slightly adjust a relative angle between the back cushion 211 and the support cushion 212 to meet the back support needs and leg placement habits of different infants. At this time, connecting the first mounting portion 22 to the edge of the side wall 12 at a top portion of the bathtub body 1 and the second mounting portion 23 to the edge of the side wall 12 in the area from the middle end to the rear end of the bathtub body 1 is defined as a first connection mode. Through the first connection mode, the back cushion 211 and the support cushion 212 can be stably supported on the side wall 12 of the bathtub body 1, allowing the infant to lie on the support portion 21.

Furthermore, a tail end of the side wall 12 extending upwards is provided with a curved portion 121.

In this embodiment, by providing the curved portion 121 at the tail end of the side wall 12 extending upwards, the first mounting portion 22 and the second mounting portion 23 can be better detachably connected to the side wall 12, providing better stability and support. The design of the curved portion 121 not only increases a contact area between the first mounting portion 22 and the side wall 12, as well as a contact area between the second mounting portion 23 and the side wall 12, thereby enhancing the firmness of the connection, but also facilitates a smoother installation process and reduces resistance during installation. In addition, the presence of the curved portion 121 can also, to some extent, disperse the pressure generated during use, extending the service life of the product.

Furthermore, the curved portion 121 is inverted U-shaped.

Furthermore, the first mounting portion 22 includes a top connecting strap 221 and a top fixing buckle 222. A first end of the top connecting strap 221 is connected to a lower surface of the back cushion 211, and the top fixing buckle 222 is arranged at a second end of the top connecting strap 221. The top fixing buckle 222 is coupled to the curved portion 121 at a top portion of the side wall 12.

Through the above structural arrangement, the second end of the top connecting strap 221 can be provided with a placement hole to connect the top fixing buckle 222. After the top fixing buckle 222 passes through the placement hole, the top fixing buckle 222 is coupled to the curved portion 121 at the top portion of the side wall 12, so that a top end of the bath cushion 2 is fixed, thereby ensuring that the back cushion 211 will not shake randomly during use.

Furthermore, the second mounting portion 23 includes a lateral fixing buckle 231. Two sides of the second end of the support cushion 212 each extend to form a lateral connecting strap 232. The lateral fixing buckle 231 is arranged at one end of the lateral connecting strap 232 facing the support portion. The lateral fixing buckle 231 is coupled to the curved portion 121 of an edge of the side wall 12 on the second end of the bathtub body 1.

Through the above structure, the end of the lateral connecting strap 232 facing the support portion can be provided with a placement hole to connect the lateral fixing buckle 231. After the lateral fixing buckle 231 passes through the placement hole, the second end of the support cushion 212 is firmly fixed to the curved portion 121 of the edge of the side wall 12 on the second end of the bathtub body 1, that is, a bottom end of the bath cushion 2 can be firmly fixed to the side wall 12 of the bathtub body 1. The user only needs to couple the lateral fixing buckle 231 positioned on the lateral connecting strap 232 to the curved portion 121 positioned from a middle portion to a bottom portion of the side wall 12 to achieve the fixation of the bottom end of the bath cushion 2. Due to the tight fit between the lateral fixing buckle 231 and the curved portion 121, the bath cushion 2 is not easy to shift or shake during use, thereby ensuring the safety and comfort experience of the user.

In one embodiment, the support cushion 212 includes a first support cushion 2121 and a second support cushion 2122.

A first end of the first support cushion 2121 is flexibly connected the second end of the back cushion 211. Two leg holes 21211 are defined in the first support cushion 2121. The two leg holes 21211 are arranged at intervals. The second mounting portion 23 is positioned at an end portion of a second end of the first support cushion 2121.

A first end of the second support cushion 2122 is flexibly connected to the second end of the back cushion 211. The second support cushion 2122 is spaced apart from the bottom wall 11 and positioned below the first support cushion 2121. A second end of the second support cushion 2122 is also provided with a connecting member 21221. The first support cushion 2121 is detachably connected to the second support cushion 2122 through the connecting member 21221.

In this embodiment, the support cushion 212 includes a first support cushion 2121 and a second support cushion 2122. A first end of the first support cushion 2121 and a first end of the second support cushion 2122 are both flexibly connected to the second end of the support cushion 211. The first support cushion 2121 is provided with leg holes 21211 arranged at intervals. The second support cushion 2122 is positioned below the first support cushion 2121. The second support cushion 2122 is spaced apart from the bottom wall 11. Therefore, when the connecting member 21221 is connected to the first support cushion 2121, the second support cushion 2122 covers the leg holes 21211 of the first support cushion 2121. Alternatively, when the connecting member 21221 is not connected to the first support cushion 2121, the first support cushion 2121 rotates at the second end of the back cushion 211, so that the leg holes 21211 of the first support cushion 2121 are exposed, allowing the user to selectively use the leg holes 21211 of the first support cushion 2121 as needed. In addition, the flexible connection between the first support cushion 2121 and the second support cushion 2122 allows the support cushion 212 to bend and deform relative to the back cushion 211, thereby improving the comfort of infants during use. The detachable design of the connecting member 21221 makes the connection between the first support cushion 2121 and the second support cushion 2122 more convenient. When the bath cushion 2 is connected to the bathtub body 1 through the first connection mode, the user can choose whether to expose the infant's legs when the infant is lying on the support portion 21 according to actual needs.

Furthermore, the second end of the first support cushion 2121 is provided with a plurality of openings 21223. A total number of the connecting members 21221 is multiple. The connecting members 21221 are configured as snap buttons 21222. The snap buttons 21222 are snapped into the openings 21223 of the first support cushion 2121.

Through the above structural arrangement, the connecting member 21221 arranged on the second support cushion 2122 can be installed to or detached from the first support cushion 2121 by the user through the snap button 21222, thereby adjusting a connection state between the first support cushion 2121 and the second support cushion 2122 to choose whether to expose the leg holes 21211. A total number of the snap buttons 21222 and a total number of the openings 21223 can be configured according to actual needs to ensure stable connection and easy operation.

In one embodiment, the multifunctional infant bathing system further includes a third mounting portion 24.

An end portion of the second end of the first support cushion 2121 is further provided with a through hole 21212 extending along a width direction. The third mounting portion 24 is detachably arranged in the through hole 21212. Two ends of the third mounting portion 24 are detachably connected to the side wall 12 in the middle of the bathtub body 1.

In this embodiment, the third mounting portion 24 is provided on the first support cushion 2121. The first support cushion 2121 is provided with the through hole 21212 extending along the width direction, and the third mounting portion 24 is detachably arranged inside the through hole 21212. When the two ends of the third mounting portion 24 are connected to the side wall 12 in the middle of the bathtub body 1, and the first mounting portion 22 is connected to an edge of the side wall 12 at a top portion of the bathtub body 1, a stable triangular support structure is formed between the first support cushion 2121, the back cushion 211, and the bathtub body 1, enhancing the overall stability of the bath cushion 2. This design makes the bath cushion 2 less likely to shake when the infant lies on the support portion 21, providing a safer and more stable bathing environment for the infant.

When the first mounting portion 22 is connected to the edge of the side wall 12 at the top portion of the bathtub body 1, the third mounting portion 24 is connected to the side wall 12 in the middle of the bathtub body 1, and the connecting member 21221 arranged on the second support cushion 2122 is not connected to the first support cushion 2121, the first support cushion 2121 exposes the leg holes 21211. The infant can sit on the bath cushion 2 by passing legs through the leg hole 21211, and the triangular support structure can stably support the infant's buttocks, ensuring that the infant can also receive sufficient support in a sitting position.

Furthermore, the third mounting portion 24 includes a support rod 241 and insertion members 242. The insertion members 242 are two in number. Two ends of the support rod 241 are respectively connected to the two insertion members 242. The two insertion members 242 are respectively inserted into the side wall 12 in the middle of the bathtub body 1.

In this embodiment, the insertion member 242 can be connected to the side wall 12 of the bathtub body 1 through an elastic buckle structure or a threaded connection structure, making it easy for the user to quickly install or detach the third mounting portion 24 according to actual needs. The design of the elastic buckle structure enables the insertion member 242 to undergo certain elastic deformation when subjected to an external force, and then be snapped into or pulled out from a corresponding hole in the side wall 12 of the bathtub body 1 for easy operation and stable connection. The threaded connection structure achieves a firm connection by rotating the insertion member 242 to allow it to tightly engage with a threaded hole in the side wall 12 of the bathtub body 1, which is suitable for use scenarios that require higher stability. By placing the support rod 241 in the through hole 21212, the two ends of the support rod 241 can be stably connected to the two insertion members 242 respectively, thereby forming a complete structure of the third mounting portion 24. Therefore, under the action of the two insertion members 242, two ends of the third mounting portion 24 are firmly installed on the side wall 12 of the bathtub body 1 to support the bottom end of the bath cushion 2.

Furthermore, the insertion member 242 includes a fixing seat 2421 and a movable buckle 2422. A first side of the fixing seat 2421 facing the bath cushion 2 is provided with a receiving slot 2423 for receiving an end portion of the support rod 241. A second side of the fixing seat 2421 is provided with the movable buckle 2422 for coupling the fixing seat 2421 to the side wall 12.

Through the above structural arrangement, the fixing seat 2421 accommodates the end portion of the support rod 241 through the receiving slot 2423, avoiding the shaking or falling off of the support rod 241. The movable buckle 2422 enables the fixing seat 2421 to be easily coupled to the curved portion 121 on the side wall 12 of the bathtub body 1, further improving the convenience and stability of installation. Simply adjusting a length of the support rod 241 enables adaptation to the bathtub body 1 on the market equipped with the curved portion 121 at the upward-extending tail end of the side wall 12. This meets the installation needs of the bathtub body 1 with different sizes and shapes, enhancing the universality and practicality of the product, and without the need to define additional mounting holes on the side wall 12 or carry out complex modifications, thereby maintaining the smoothness and integrity of the side wall 12.

Furthermore, the insertion member 242 further includes a restoration spring 2424. The fixing seat 2421 is hinged to the movable buckle 2422. The movable buckle 2422 is provided with a groove 2425 for receiving the restoration spring 2424. A first end of the restoration spring 2424 abuts against the fixing seat 2421, and a second end of the restoration spring 2424 abuts against the movable buckle 2422.

Through the above structural arrangement, when the movable buckle 2422 is opened, the restoration spring 2424 placed in the groove 2425 is compressed, while when the movable buckle 2422 is coupled to the side wall 12 of the bathtub body 1, the restoration spring 2424 releases energy, pushing the movable buckle 2422 to tightly adhere to the side wall 12 of the bathtub body 1, thereby enhancing the connection stability and sealing between the insertion member 242 and the side wall 12 of the bathtub body 1. In addition, the arrangement of the restoration spring 2424 also provides a certain buffering effect for the movable buckle 2422 when subjected to an external force, avoiding damage caused by hard collisions and further extending the service life of the product. At the same time, this structural arrangement is also convenient for the user to install and disassemble. Simply unlatch the movable buckle 2422 to achieve coupling or opening, greatly improving the convenience of use.

Furthermore, a limiting slot 2426 is defined in the movable buckle 2422. A limiting portion 3 is arranged on the side wall 12 in the middle of the bathtub body 1. The limiting portion 3 is snapped into the limiting slot 2426.

Through the above structure, the mating arrangement between the limiting slot 2426 and the limiting part 3 further enhances the stability of the connection between the movable buckle 2422 and the side wall 12 of the bathtub body 1. When the movable buckle 2422 is coupled to the curved portion 121 on the side wall 12 of the bathtub body 1, the limiting portion 3 is snapped into the limiting slot 2426 to prevent the movable buckle 2422 from moving the fixing seat 2421 due to external force, thereby ensuring a stable connection between the bath cushion 2 and the bathtub body 1.

In one embodiment, the infant bathing system further includes a cover plate 4. The cover plate 4 is disposed at a top edge of the side wall 12 on the first end of the bathtub body 1.

Through the above structural arrangement, when the cover plate 4 covers the top edge of the side wall 12 on the first end of the bathtub body 1, a connection structure between the first mounting portion 22 and the bathtub body 1 can be effectively prevented from being mistakenly touched by other people, so that the bath cushion 2 is prevented from falling off due to misoperation, and the safety of the infant in the using process is ensured.

In one embodiment, the infant bathing system further includes a bracket 5 for supporting the bathtub body 1. The bracket 5 is arranged at a bottom portion of the bathtub body 1.

Through the above structure, two ends of the bottom portion of the bathtub body 1 are provided with the brackets 5. The brackets 5 support the bathtub body 1 and raise a position of the bathtub body 1, making it more labor-saving for parents when bathing the infant.

In one embodiment, the infant bathing system further includes a hinge member 6. The hinge member 6 is fixedly arranged at two ends of the bottom portion of the bathtub body 1. The hinge member 6 is used for connecting the bracket 5 and the bathtub body 1, so that after the bracket 5 rotates relative to the bathtub body 1, the bracket 5 enters a usage state or a storage and folding state.

Through the above structural arrangement, the user can rotate the bracket 5 in the folding state through the hinge member 6, so as to raise a height of the bathtub body 1 in the usage state, or rotate the bracket 5 in the usage state, so as to fold and store the bracket 5 after the height of the bathtub body 1 is lowered, so that the bracket enters the storage and folding state.

In one embodiment, the bath cushion 2 is made of a flexible material.

Through the selection of the above-mentioned flexible material, not only are the comfort and fit of the bath cushion 2 improved, but also effective waterproof and anti-slip functions are achieved, ensuring the safety of the infant during bathing. Meanwhile, the flexible material facilitates cleaning and air-drying, further enhancing the product's practicality and hygiene.

In one embodiment, the infant bathing system further includes a blocking member 8. A water outlet hole 111 is defined in the bottom wall 11. The blocking member 8 is detachably installed inside the water outlet hole 111.

Through the above structural arrangement, the user can easily install or remove the blocking member 8 as needed to control the drainage of water from the bathtub body 1. This allows the user to conveniently adjust a water level to meet different bathing requirements or quickly drain the water from the bathtub body 1.

In one embodiment, a lower surface of the bottom wall is provided with a first anti-slip pattern 7.

Through the above structural arrangement, the first anti-slip pattern 7 increases the friction between the bathtub body 1 and the ground, effectively preventing the bathtub body 1 from sliding during use.

In one embodiment, a surface of the bath cushion 2 used for supporting the infant is provided with a second anti-slip pattern 25.

Through the above structural arrangement, the second anti-slip pattern 25 enhances the friction between the bath cushion 2 and the infant's skin, effectively preventing the infant from sliding on the bath cushion 2 and further improving the safety of the infant during bathing.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A multifunctional infant bathing system, comprising:

a bathtub body, wherein the bathtub body comprises a bottom wall and a side wall, the bottom wall and the side wall form an accommodating cavity for holding liquid, and an edge of the bathtub body extends upwards to form the side wall; and a bath cushion, wherein the bath cushion comprises a support portion, a first mounting portion, and a second mounting portion; the first mounting portion and the second mounting portion are respectively detachably connected to an edge of the side wall, and the support portion is used for supporting an infant;

wherein the support portion comprises:

a back cushion, wherein the back cushion is arranged opposite to the bottom wall, the first mounting portion is arranged on a first end of the back cushion, and the first mounting portion is detachably connected to a top edge of the side wall positioned on a first end of the bathtub body; and a support cushion, wherein a first end of the support cushion is flexibly connected to a second end of the back cushion, the second mounting portion is arranged on a second end of the support cushion, and the second mounting portion is detachably connected to any position of an edge of the side wall positioned on a second end of the bathtub body, so as to adjust a relative position of the support cushion and the back cushion, thereby providing better support for the infant;

wherein the support cushion comprises:

a first support cushion, wherein a first end of the first support cushion is flexibly connected the second end of the back cushion, two leg holes are defined in the first support cushion, the two leg holes are arranged at intervals, and the second mounting portion is positioned at an end portion of a second end of the first support cushion; and a second support cushion, wherein a first end of the second support cushion is connected to the second end of the back cushion, the second support cushion is spaced apart from the bottom wall and positioned below the first support cushion, a second end of the second support cushion is also provided with a connecting member, and the first support cushion is detachably connected to the second support cushion through the connecting member.

2. The multifunctional infant bathing system according to claim 1, further comprising:

a third mounting portion, wherein an end portion of the second end of the first support cushion is further provided with a through hole extending along a width direction, the third mounting portion is detachably arranged in the through hole, and two ends of the third mounting portion are detachably connected to the side wall in the middle of the bathtub body.

3. The multifunctional infant bathing system according to claim 2, wherein a tail end of the side wall extending upwards is provided with a curved portion.

4. The multifunctional infant bathing system according to claim 3, wherein the first mounting portion comprises a top connecting strap and a top fixing buckle, a first end of the top connecting strap is connected to a lower surface of the back cushion, the top fixing buckle is arranged at a second end of the top connecting strap, and the top fixing buckle is coupled to the curved portion at a top portion of the side wall.

5. The multifunctional infant bathing system according to claim 3, wherein the second mounting portion comprises a lateral fixing buckle, two sides of a second end of the support cushion each extend to form a lateral connecting strap, the lateral fixing buckle is arranged at one end of the lateral connecting strap facing a support portion, and the lateral fixing buckle is coupled to the curved portion of an edge of the side wall on a second end of the bathtub body.

6. The multifunctional infant bathing system according to claim 3, wherein the third mounting portion comprises a support rod and insertion members, the insertion members are two in number, two ends of the support rod are respectively connected to the two insertion members, and the two insertion members are respectively inserted into the side wall in the middle of the bathtub body.

7. The multifunctional infant bathing system according to claim 6, wherein the insertion member comprises a fixing seat and a movable buckle, a first side of the fixing seat facing the bath cushion is provided with a receiving slot for receiving an end portion of the support rod, and a second side of the fixing seat is provided with the movable buckle for coupling the fixing seat to the side wall.

8. The multifunctional infant bathing system according to claim 7, wherein the insertion member further comprises a restoration spring, the fixing seat is hinged to the movable buckle, the movable buckle is provided with a groove for receiving the restoration spring, a first end of the restoration spring abuts against the fixing seat, and a second end of the restoration spring abuts against the movable buckle.

9. The multifunctional infant bathing system according to claim 7, wherein a limiting slot is defined in the movable buckle, a limiting portion is arranged on the side wall in the middle of the bathtub body, and the limiting portion is snapped into the limiting slot.

10. The multifunctional infant bathing system according to claim 3, wherein the curved portion is inverted U-shaped.

11. The multifunctional infant bathing system according to claim 1, further comprising a cover plate, wherein the cover plate is disposed at a top edge of the side wall on a first end of the bathtub body.

12. The multifunctional infant bathing system according to claim 1, further comprising a bracket for supporting the bathtub body, wherein the bracket is arranged at a bottom portion of the bathtub body.

13. The multifunctional infant bathing system according to claim 1, further comprising a hinge member, wherein the hinge member is fixed to a bottom portion of the bathtub body, and the hinge member is used for connecting a bracket and the bathtub body, so that after the bracket rotates relative to the bathtub body, the bracket enters a usage state or a storage and folding state.

14. The multifunctional infant bathing system according to claim 1, wherein the second end of the first support cushion is provided with a plurality of openings, a total number of the connecting members is multiple, the connecting members are configured as snap buttons, and the snap buttons are snapped into the openings of the first support cushion.

15. The multifunctional infant bathing system according to claim 1, wherein the bath cushion is made of a flexible material.

16. The multifunctional infant bathing system according to claim 1, further comprising a blocking member, wherein a water outlet hole is defined in a bottom portion of the bottom wall, and the blocking member is detachably installed inside the water outlet hole.

17. The multifunctional infant bathing system according to claim 1, wherein a lower surface of the bottom wall is provided with a first anti-slip pattern.

18. The multifunctional infant bathing system according to claim 1, wherein a surface of the bath cushion used for supporting the infant is provided with a second anti-slip pattern.

19. A multifunctional infant bathing system, comprising:

a bathtub body, wherein the bathtub body comprises a bottom wall and a side wall, the bottom wall and the side wall form an accommodating cavity for holding liquid, and an edge of the bathtub body extends upwards to form the side wall; and a bath cushion, wherein the bath cushion comprises a support portion, a first mounting portion, and a second mounting portion; the first mounting portion and the second mounting portion are respectively detachably connected to an edge of the side wall, and the support portion is used for supporting an infant;

a cover plate, wherein the cover plate is disposed at a top edge of the side wall on a first end of the bathtub body.

* * * * *